United States Patent [19]

Montgomery, Sr.

[11] Patent Number: 5,037,100

[45] Date of Patent: Aug. 6, 1991

[54] PUTTING AID

[75] Inventor: Anthony J. Montgomery, Sr., Portland, Oreg.

[73] Assignee: The Golf Team Inc., Portland, Oreg.

[21] Appl. No.: 557,463

[22] Filed: Jul. 25, 1990

[51] Int. Cl.[5] ..... A63B 69/36

[52] U.S. Cl. ..... 273/183 E; 273/192; 273/186 C; 273/186 A; 206/315.1

[58] Field of Search ..... 273/194 A, 192, 186 R, 273/186 B, 186 C, 191 R, 191 A, 183 E, 183 R, 186 A

[56] References Cited

U.S. PATENT DOCUMENTS 1,173,384 2/1916 Rees ..... 273/194 A 3,269,733 8/1966 Taddre et al. ..... 273/192

*Primary Examiner*—George J. Marlo

*Attorney, Agent, or Firm*—Eugene M. Eckelman

[57] ABSTRACT

A flat plate-like base member is arranged to be seated on a supporting surface. An upstanding pedestal is mounted on the top surface of the base member and has a front surface from which at least one elongated straight rod has cantilevered support in a plane parallel with the base member. The rod is supported at a height whereby a golf ball on the supporting surface and a putter head can be located freely thereunder so that the putter head can be moved into contact with the ball. The rod is of a length whereby the putter head can be moved therealong through a putting stroke while the golfer sights down on the putter head and golf ball in relation to the rod whereby to encourage a straight line impact against the ball. The rod is constructed of at least two disconnectable parts and the top surface of the base has recesses for holding these rod parts as well as golf balls when the putting aid is not in use. The base has vertical corner apertures arranged to receive anchor stakes if necessary to positively hold the putting aid on a putting surface. A cover is hingedly mounted on the base member for covering the tip surface thereof including the pedestal and recess. A pair of the rods may be mounted on the pedestal in parallel relation to each other and provide an area therebetween for a golfer to sight down to view the putter head and ball.

5 Claims, 2 Drawing Sheets

PUTTING AID

BACKGROUND OF THE INVENTION

This invention relates to new and useful improvements in putting aids.

Various devices have been conceived for the practice putting of golf balls. Some devices have primarily been designed for the golfer's convenience in that they are adapted to receive and catch a ball that has been putted. Some return the ball as well. Putting tracks that guide the stroke by providing a wall on the heel and toe side of the putter to act as a groove for the putting stroke are also available. Similar concepts have been conceived that control the movement of the putter head. Although these prior devices provide some benefits to golfers for the practice of putting toward a target and for distance, they are not designed to develop a stroke with important requisites of moving the putter in a square putting stroke, of accelerating the stroke at the ball, of building a controlled compact stroke with a feeling of alignment, and of injecting these fundamentals into muscle memory and other important requisites.

SUMMARY OF THE INVENTION

According to the present invention and forming a primary objective thereof, a putting aid is provided that is combined with a putter and ball in an improved manner over the prior devices in that it develops important fundamentals of putting and injects them into muscle memory.

A more particular object of the invention is to provide longitudinal guide means along which the putter is directed whereby the golfer, when viewing the putter head and golf ball from above, is required to move the putter rearwardly and forwardly in straight line movements. Also with proper positioning of the ball relative to a base for the invention, a restricted backswing for the putter is accomplished. These requirements develop the important fundamentals of putting that inject them into the said muscle memory.

Another object of the invention is to provide a putting aid that is arranged to be compacted when not in use and also has facility for storing golf balls and tees.

In carrying out the objectives of the invention, a base is provided that is arranged to be placed on a supporting surface. Elongated straight guide means is mounted on the base in an outwardly projecting position parallel with the supporting surface. Such guide means is held on the base at a sufficient height to receive a golf ball and putter head freely thereunder and is of sufficient length to guide the putter head rearwardly and forwardly through a putting stroke, such stroke being performed with the golfer viewing the putter head from above, whereby to encourage a straight line movement of the club. The guide means is adjustable angularly on the base, and the base is associated with anchor means for stabilizing it in position if necessary. The guide means is constructed segmentally for compacting it when not in use and the base has means for storing the compacted guide means as well as other golf equipment.

The invention will be better understood and additional objects and advantages will become apparent from the following description taken in connection with the accompanying drawings.

DETAILED DESCRIPTION OF A PREFERRED EMBODIMENT

Figures 1, 2, 3:
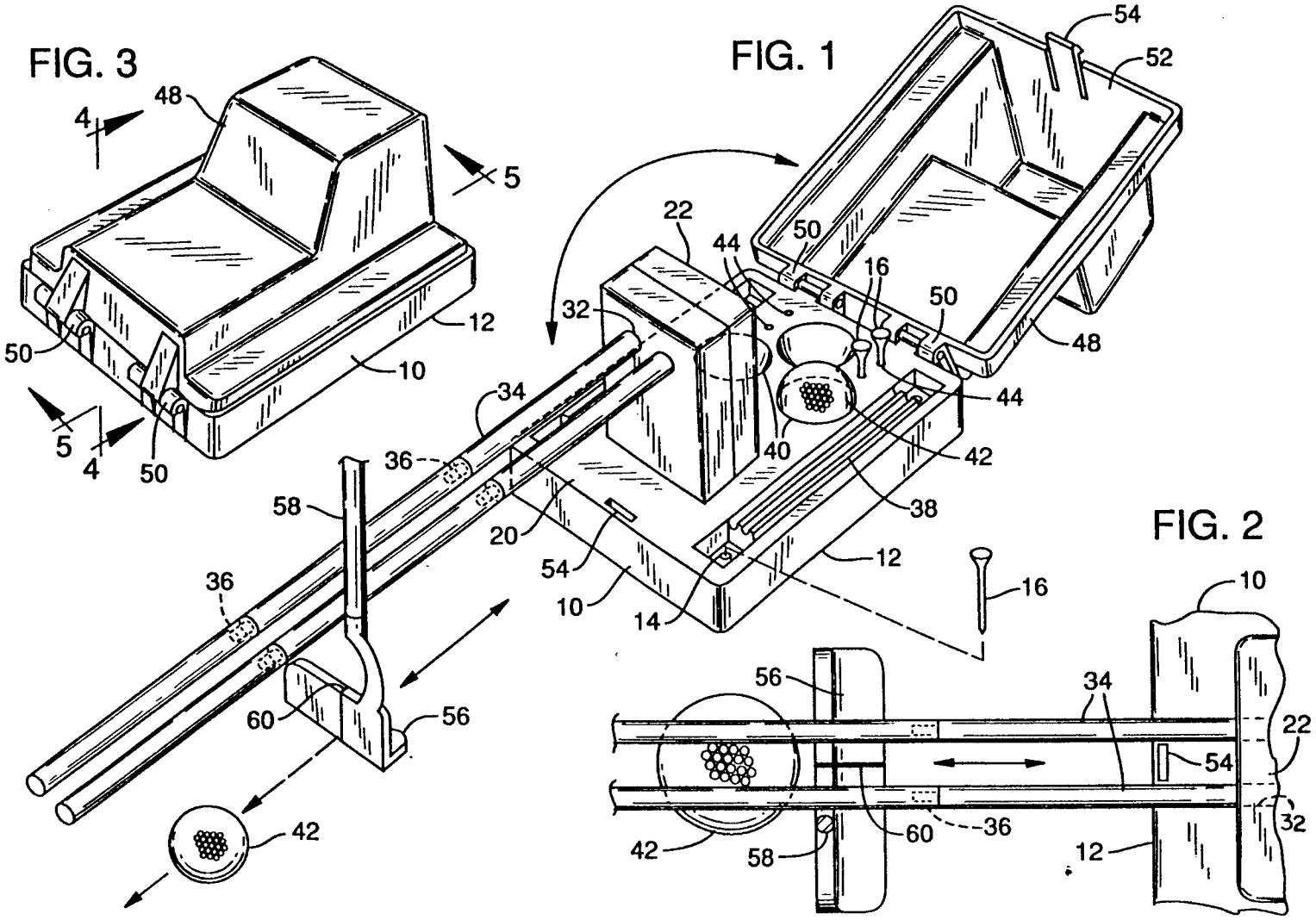
FIG. 1 is a perspective view of a first form of the present putting aid and one manner of using it.
FIG. 2 is an enlarged fragmentary plan view looking down on guide means of the FIG. 1 embodiment and showing such guide means, putter head and golf ball as they would be viewed by a person practicing putting.
FIG. 3 is a perspective view of the putting aid in compacted position for shipment or storage.
Figure 4:
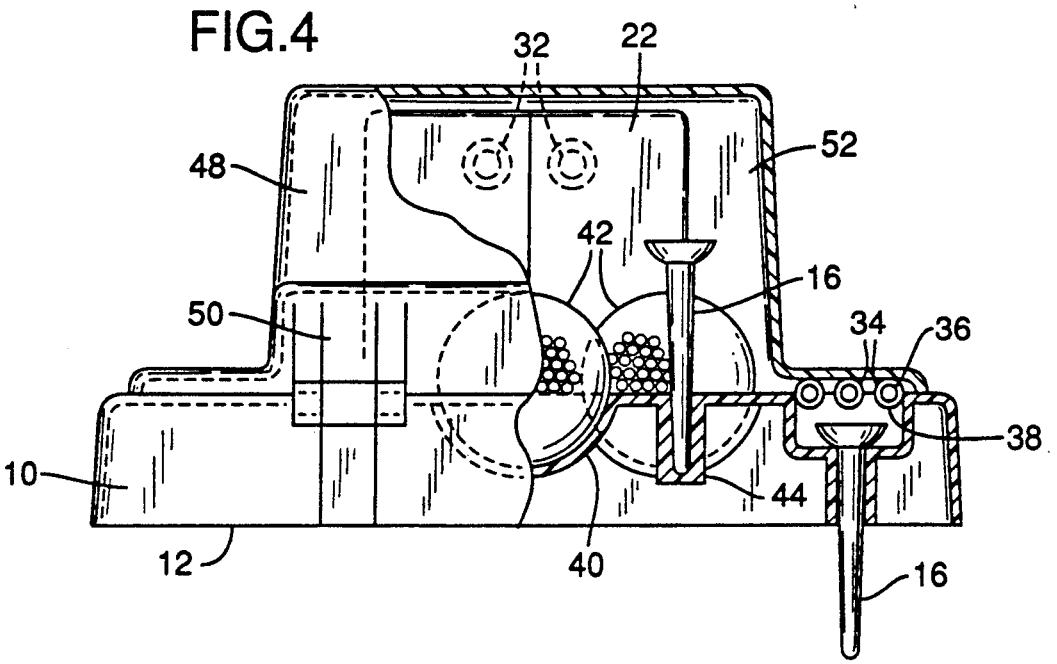
FIG. 4 is a rear elevational view taken on the line 4—4 of FIG. 3, a portion of this view being broken away to show details of structure.
Figure 5:
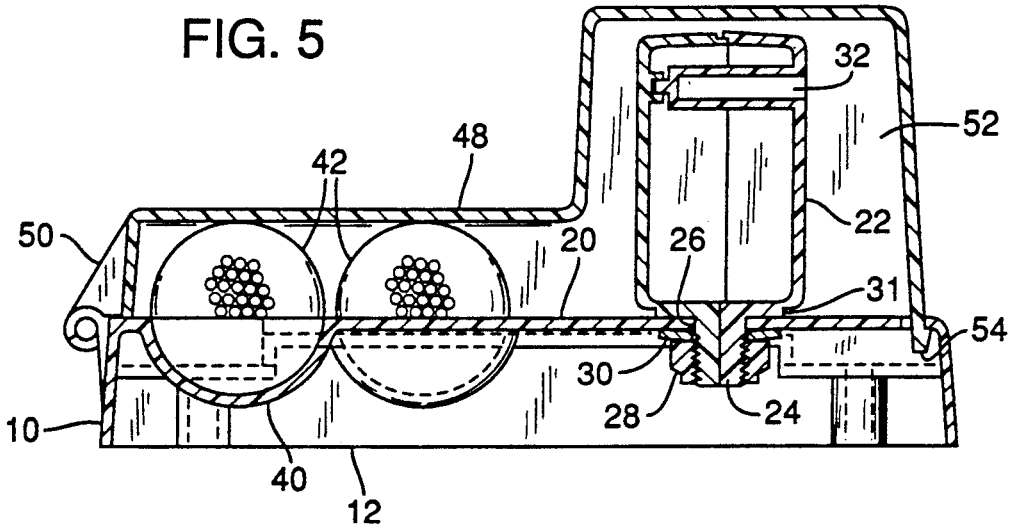
FIG. 5 is a longitudinal sectional view taken on the line 5—5 of FIG. 3.

With particular reference to the drawing, and first to FIGS. 1-5, the putting aid of the present invention comprises a flat, plate-like base 10 having bottom edge or surface portions 12 that support the base flatwise on a putting surface. The device may be used on any type of putting surface such as putting greens or indoor carpets, and includes corner apertures 14 arranged to receive anchor means 16 such as golf tees or other means arranged to engage the ground when used on a green and stabilize the device in a set position.

The base 10 has a top wall surface 20 on which is supported, adjacent the front of the base, a pedestal 22 having a bottom threaded stud extension 24 extending through an aperture 26 in the wall 20 and receiving a nut 28 and wave washer 30 arranged to clamp the pedestal on the base. By loosening the nut 28, or by forced rotation of the pedestal, it can be turned to selected angles relative to the base. Pedestal 22 has a reduced dimension seat 31 that allows adjustable pivotal movement of the pedestal without visible scratching of surface 20.

Pedestal 22 has a pair of sockets 32 in its front surface arranged to receive elongated rods 34 and hold the rods in outwardly cantilevered projecting position parallel with the supporting or putting surface. The rods 34 are preferably from about one foot to two feet in length to accomplish the desired putting stroke, to be described, and are segmentally constructed, as by suitable male-female connections 36 which allow them to be broken down into short lengths. The top wall 20 of the base 10 has longitudinal recesses 38 at the sides for storing these compacted rods when not in use. Wall 20 also is provided with recesses 40 to store golf balls 42 and recesses 44 to store the anchor tees 16.

The device has a lid or cover portion 48 with a hinge connection 50 at the rearward end and has an inner contour 52 capable of covering the base including the pedestal 22. When closed, the lid seats on the top wall 20 of the base and has a latch connection 54 therewith for locking connection.

With particular reference to FIGS. 1 and 2, the device of FIG. 1 when in use is opened up and the rods 34 placed in the respective sockets 32. As stated, these rods are supported outwardly in projecting position parallel with the supporting or putting surface. Also, the rods are held on the base at a sufficient height to receive a golf ball and putter head freely thereunder. When practicing putting, the golfer places the ball on the putting surface under the rods 34. The head 56 of the putter is also positioned under the rods. The shaft 58 of the putter preferably projects up on the side adjacent the golfer, or it may extend up between the rods, depending upon the construction of the putter and the desire of the golfer. The golfer then retracts the putter in a back swing with the shaft traveling rearwardly in precise parallel movement with the rods. Preferably the putter shaft does not touch the rods. With this steadying influence for the golfer, he or she will learn to draw the putter back in a straight and unwavy line. After completing the back swing, the putter is moved into its forward swing, still being guided by the rods and without touching the rods if desired. Likewise, the forward swing of the putter is maintained in a straight line, thus inducing the golfer to accomplish a square putting stroke. Putter heads 56 usually have an alignment mark 60 on the top surfaces thereof which will assist the golfer in moving the putter in a straight line parallel with the rods.

Another practicing function of the present device is to place the golf ball 42 rather close to the base, whereby the golfer must restrict the length of the back swing. This arrangement teaches the elimination of a long back swing. Also, with this shorter back swing, the golfer can be taught to strike the ball while accelerating the putter head, thus accomplishing the desired restricted back swing and accelerating forward putting stroke.

Figure 6:
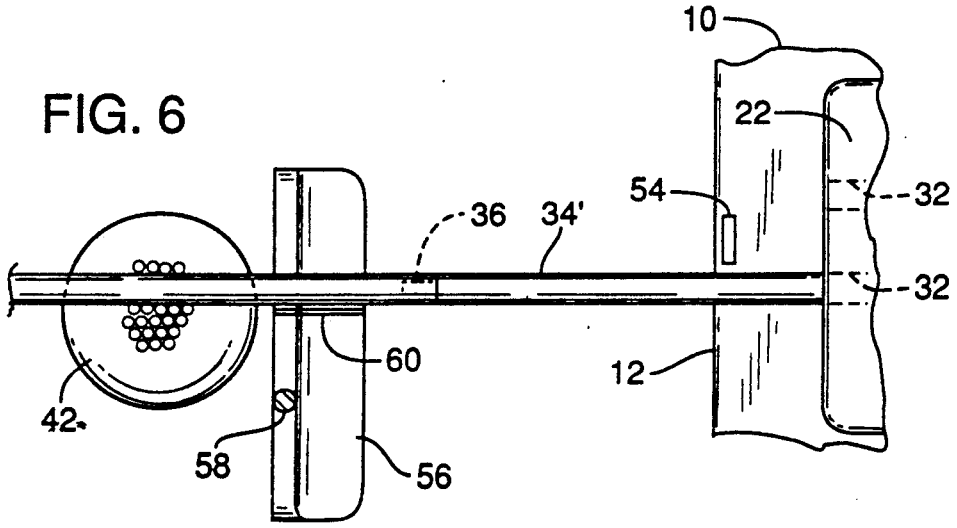
FIG. 6 is a fragmentary plan view of a modified form of the invention.

FIG. 6 is a view similar to FIG. 2 but shows an embodiment of the invention that uses a single guide rod 34'. Use of the device is almost identical to that of the FIG. 1 embodiment in that the ball and the putterhead are beneath the guide rod and the golfer looks down on the rod and ball and putter head for using the rod to guide the putting swing.

The pedestal can be directed straight out frontwise of the base or it can be angled obliquely, depending upon the desire of the golfer.

The concept of the invention is that the golfer trains himself or herself by the visual instant feed-back that is provided. Also, the golfer is equipped with the means that will enable him or her to practice the right way. The benefits that the golfer will receive include instant feedback, a controlled environment around the putter for fundamental improvement and reinforcement, and the knowledge of exactly what is happening so that it is injected into muscle memory. The device is also compact, portable, light in weight, and has storage means directly therein for alignment rods, golf balls and tees.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. A putting aid comprising:

a flat plate-like base member having front, rear and side portions and arranged to be seated on a supporting surface, an upstanding pedestal mounted on said base member having a front surface, and at least one elongated straight rod having cantilevered support at one of its ends in projecting relation from the front surface of said pedestal and also projecting beyond said base member in a plane parallel with said base member, said rod being supported on said pedestal at a height whereby a golf ball on the supporting surface and a putter head can be located freely thereunder, said rod being of a length whereby a putter head can be moved therealong through a putting stroke while sighting down on the putter head and golf ball in relation to said rod to encourage a straight line impact against the golf ball on the supporting surface.

2. The putting aid of claim 1 including a pair of said rods projecting from the front surface of said pedestal in parallel relation to each other and space apart sufficiently for a golfer to sight down therebetween to view the putter head and ball and to guide the putter head in a straight putting stroke against the ball.

3. The putting aid of claim 1 wherein said pedestal is adjustably mounted on said base on a vertical axis for varying the projecting angle of said rod relative to said base.

4. The putting aid of claim 1 wherein said rod is constructed of at least two disconnectable parts for compacting it when not is use.

5. The putting aid of claim 4 wherein said base includes a top surface, recess means in said top surface for holding said rod parts when disconnected as well as golf balls when said putting aid is not in use, vertical corner apertures arranged to removably receive ground anchor stakes, and a cover hingedly mounted on said base member for covering the top surface of said base member including said pedestal and recess means.

* * * * *